US010808887B2

(12) United States Patent
Antola et al.

(10) Patent No.: US 10,808,887 B2
(45) Date of Patent: Oct. 20, 2020

(54) METHOD AND SYSTEM FOR DETERMINING AND MANAGING BOIL-OFF RATE

(71) Applicant: Eniram Oy, Helsinki (FI)

(72) Inventors: Matti Antola, Helsinki (FI); Antti Solonen, Espoo (FI)

(73) Assignee: Eniram Oy, Helsinki (FI)

( * ) Notice: Subject to any disclaimer, the term of this patent is extended or adjusted under 35 U.S.C. 154(b) by 215 days.

(21) Appl. No.: 15/770,243

(22) PCT Filed: Oct. 24, 2016

(86) PCT No.: PCT/FI2016/050746

§ 371 (c)(1),
(2) Date: Apr. 23, 2018

(87) PCT Pub. No.: WO2017/072408

PCT Pub. Date: May 4, 2017

(65) Prior Publication Data

US 2018/0313498 A1 Nov. 1, 2018

(30) Foreign Application Priority Data

Oct. 26, 2015 (FI) ..... 20155761

(51) Int. Cl.
*F17C 13/02* (2006.01)
*F17C 1/00* (2006.01)
(Continued)

(52) U.S. Cl.
CPC ..... *F17C 13/02* (2013.01); *F17C 1/00* (2013.01); *F17C 13/04* (2013.01); *F17C 13/082* (2013.01);
(Continued)

(58) Field of Classification Search
CPC ..... F17C 13/02; F17C 13/025; F17C 13/026; F17C 7/02; F17C 7/04; F17C 2223/0161; F17C 2260/0636
See application file for complete search history.

(56) References Cited

U.S. PATENT DOCUMENTS

2003/0182947 A1 10/2003 Kimble et al.
2005/0115248 A1 6/2005 Koehler et al.
(Continued)

FOREIGN PATENT DOCUMENTS

KR 20110024501 A 3/2011
KR 20150052980 A 5/2015
(Continued)

OTHER PUBLICATIONS

WO2009074757 Translation.*
(Continued)

*Primary Examiner* — Brian M King
(74) *Attorney, Agent, or Firm* — Ziegler IP Law Group, LLC

(57) ABSTRACT

A method and system for determining a momentary boil-off rate for a storage tank for a natural gas in liquid phase and gas phase. A mass flow from the gas phase of the natural gas at an discharge pipeline of the storage tank and a mass flow into the liquid phase of the natural gas at an loading/discharge pipeline of the storage tank is determined. A volume, a temperature and a pressure of the gas phase of the natural gas is measured. A dynamical model is applied to the determined values to determine the momentary boil-off rate.

15 Claims, 6 Drawing Sheets

(51) Int. Cl.
*F17C 13/04* (2006.01)
*F17C 13/08* (2006.01)

(52) U.S. Cl.
CPC ..... *F17C 2221/033* (2013.01); *F17C 2223/0123* (2013.01); *F17C 2225/013* (2013.01); *F17C 2250/032* (2013.01); *F17C 2250/034* (2013.01); *F17C 2250/043* (2013.01); *F17C 2250/0408* (2013.01); *F17C 2250/0421* (2013.01); *F17C 2250/0439* (2013.01); *F17C 2250/0443* (2013.01); *F17C 2250/0447* (2013.01); *F17C 2250/0491* (2013.01); *F17C 2250/0495* (2013.01); *F17C 2250/0694* (2013.01); *F17C 2265/03* (2013.01)

(56) References Cited

U.S. PATENT DOCUMENTS

| | | | |
|---|---|---|---|
| 2011/0225986 | A1 | 9/2011 | Germond et al. |
| 2014/0333444 | A1 | 11/2014 | Grant et al. |

FOREIGN PATENT DOCUMENTS

| | | | |
|---|---|---|---|
| KR | 20150055940 | A | 5/2015 |
| WO | 2009074757 | A1 | 6/2009 |
| WO | 2014105286 | A1 | 7/2014 |

OTHER PUBLICATIONS

Finnish Patent and Registration Office, Search Report, Application No. 20155761, dated Feb. 12, 2016, 2 pages.

G. Dimopoulos, C Frangopoulos, "A Dynamic Model for Liquiefied Natural Gas Evaporation During Marine Transportation", Int. J. of Thermodynamics, vol. 11, No. 3, Sep. 1, 2008, ISSN: 1301-9724, 10 pages.

The International Search Report and Written Opinion of the International Searching Authority, Application No. PCT/FI2016/050746, dated Feb. 13, 2017, 13 pages.

* cited by examiner

METHOD AND SYSTEM FOR DETERMINING AND MANAGING BOIL-OFF RATE

TECHNICAL FIELD

The present disclosure relates generally to the transportation of natural gas; and more specifically, to a method and system for determining the boil-off rate of the natural gas in storage tanks, as well as a method for controlling the storage tanks.

BACKGROUND

Natural gas is an energy efficient fuel and used across the world for various home or industry purposes. The natural gas is available in a gas phase in nature due to its extremely low boiling point of approximately −162° C. at atmospheric pressure. Further, the mass density of the gas phase of the natural gas is relatively 700 times lower than mass density of a liquid phase of the natural gas. The liquid phase of the natural gas can also be referred to as a liquefied natural gas (LNG). In other words, the volume of the LNG takes up about 1/700th of the volume of the gas phase. Further, LNG achieves a higher reduction in volume than compressed natural gas (CNG) and the (volumetric) energy density of LNG is 2.4 times greater than the CNG or 60 percent greater than diesel fuel. This makes LNG a cost efficient fuel to transport over long distances where pipelines do not exist. LNG can be transported with a vessel (also referred as a LNG carrier/LNG tanker/LNG ship capable of floating in a body of water) having one or more cryogenic storage tanks.

Generally, the natural gas is first processed to remove impurities such as water, oil, mud, mercury, other gases, for example $CO_2$ and $H_2S$ and later liquefied and stored in a specially designed cryogenic storage tanks in its liquid phase. The cryogenic storage tanks are configured to store LNG at a temperature near its boiling point (−162° C.) at atmospheric pressure. Although the cryogenic storage tank is thermally insulated, as heat is continually transmitted from the outside to LNG in the storage tank, LNG is continually vaporized and boil-off gas is generated within the storage tank. As the volume requirement of the gas phase of natural gas is approximately 700 times more than the volume requirements of LNG for a constant mass, an increase in pressure within the storage tank is observed. Further, adverse consequences such as tank leaks or explosion may happen if the pressure within the tank increases in a significant manner.

A typical boil-off rate can be 0.05-0.15% of the tanks total volume per day which can amount to $5M-$15M losses annually for a large scale LNG carrier. The boil-off vapour is typically used as a propulsion fuel by LNG carrier, or in some cases re-liquefied and inserted back into the tanks. As the costs of LNG fluid and heavy fuel oil vary, so do the optimal operating modes.

A momentary boil-off rate captures the variation of the boil-off rate in time, for example due to the operator spraying the tanks with liquid LNG. A momentary boil-off rate that is known substantially without delay is called a real-time boil-off rate.

If a momentary boil-off measurement was available, it would allow managing operations more efficiently. Currently efficient management of boil-off on LNG carriers is driven by the expertise of the operator who has no direct visibility to the momentary variation of the boil-off rate. In addition, with a momentary boil-off measurement, the long-term performance of the tanks could be followed and compared between different vessels. Finally, with a real-time boil-off rate, the effect of a sudden increase in boil-off rate on tank pressures could be pre-emptively countered.

The naive way to estimate boil-off rate is to calculate it from changes in the volume of the liquid phase, but this signal is too noisy for obtaining the boil-off rate with adequate time resolution.

Various attempts have been made to control and manage the effects of the boil-off for the storage tank. In an example, the tank pressures are monitored with pressure sensors so as to take a corrective action when the pressure within the tank increases beyond a threshold pressure value. However, the pressure in the storage tank corresponds to an indirect indication of the boil-off rate and it responds to an increased boil-off rate with a lag. As a result, the method fails to indicate a sudden increase in the boil-off rate and the storage tank remains suspected to the adverse consequences.

Therefore, in light of the foregoing discussion, there exists a need to overcome the aforementioned drawbacks of determining and controlling a boil-off rate while transporting natural gas in storage tanks.

SUMMARY

The present disclosure seeks to provide a method for determining a momentary boil-off rate for a storage tank.

The present disclosure further seeks to provide a system for controlling or managing vessel operations (or parts of the vessel such as the storage tanks) with the determined boil-off rate.

In one aspect, an embodiment of the present disclosure provides a method for determining a momentary boil-off rate for a storage tank for a natural gas in liquid phase and gas phase, the method comprising the steps of:

- determining a mass flow from the gas phase of the natural gas at a discharge pipeline of the gas phase of the storage tank;
- determining a volume of the gas phase of the natural gas and a volume of the liquid phase of the natural gas in the storage tank;
- measuring a temperature and a pressure of the gas phase of the natural gas in the storage tank;
- determining a density of the gas phase of the natural gas in the storage tank using a thermodynamic equation of state, the temperature in the storage tank, the pressure of the gas phase of the natural gas in the storage tank and a molar mass of the natural gas;
- determining a mass of the gas phase of the natural gas in the storage tank by using the determined density of the gas phase of the natural gas and the determined volume of the gas phase of the natural gas;
- determining a mass of the liquid phase of the natural gas in the storage tank by using a mass density of the liquid phase of the natural gas and the determined volume of the liquid phase of the natural gas and
- applying a dynamical model to the measured and determined values to determine the momentary boil-off rate of the natural gas in the storage tank.

In another aspect, an embodiment of the present disclosure provides a method for controlling a storage tank for a natural gas in liquid phase and gas phase, wherein a real time boil-off rate is determined according to the present disclosure and the determined boil-off rate is used as input to a control unit controlling operation of an at least one valve or at least one compressor related to the storage tank.

In yet another aspect, an embodiment of the present disclosure provides a system for controlling a vessel comprising a storage tank for a natural gas in liquid phase and gas phase, the system comprising:

- a storage tank for a natural gas in liquid phase and gas phase and comprising at least one discharge pipeline for the gas phase;
- means for determining a mass flow from gas phase of the natural gas at a discharge pipeline of the gas phase of the storage tank,
- means for measuring a temperature and a pressure of the gas phase of the natural gas in the storage tank;
- means for determining a volume of the gas phase of the natural gas in the storage tank, a volume of the liquid phase of the natural gas in the storage tank, a density of the gas phase of the natural gas in the storage tank, a mass of the gas phase of the natural gas in the storage tank and a mass of the liquid phase of the natural gas in the storage tank;
- a boil-off rate measuring unit configured to apply a dynamical model to the measured values to determine real-time boil-off rate of the natural gas in the storage tank; and
- a control unit configured to use the determined real-time boil-off rate in the storage tank to control at least one operation related to the vessel.

Embodiments of the present disclosure substantially eliminate or at least partially address the aforementioned problems in the prior art, and provide a method for determining a substantially real-time boil-off rate or a momentary boil-off rate by applying a dynamical model on measured values of thermodynamic and flow variables. Subsequently, the real-time boil-off rate is used to control operations of the storage tank and a LNG carrier.

Additional aspects, advantages, features and objects of the present disclosure would be made apparent from the drawings and the detailed description of the illustrative embodiments construed in conjunction with the appended claims that follow.

It will be appreciated that features of the present disclosure are susceptible to being combined in various combinations without departing from the scope of the present disclosure as defined by the appended claims.

BRIEF DESCRIPTION OF THE DRAWINGS

The summary above, as well as the following detailed description of illustrative embodiments, is better understood when read in conjunction with the appended drawings. For the purpose of illustrating the present disclosure, exemplary constructions of the disclosure are shown in the drawings. However, the present disclosure is not limited to specific methods and instrumentalities disclosed herein. Wherever possible, similar elements have been indicated by identical numbers.

Embodiments of the present disclosure will now be described, by way of example only, with reference to the following diagrams wherein.

Figure 1:
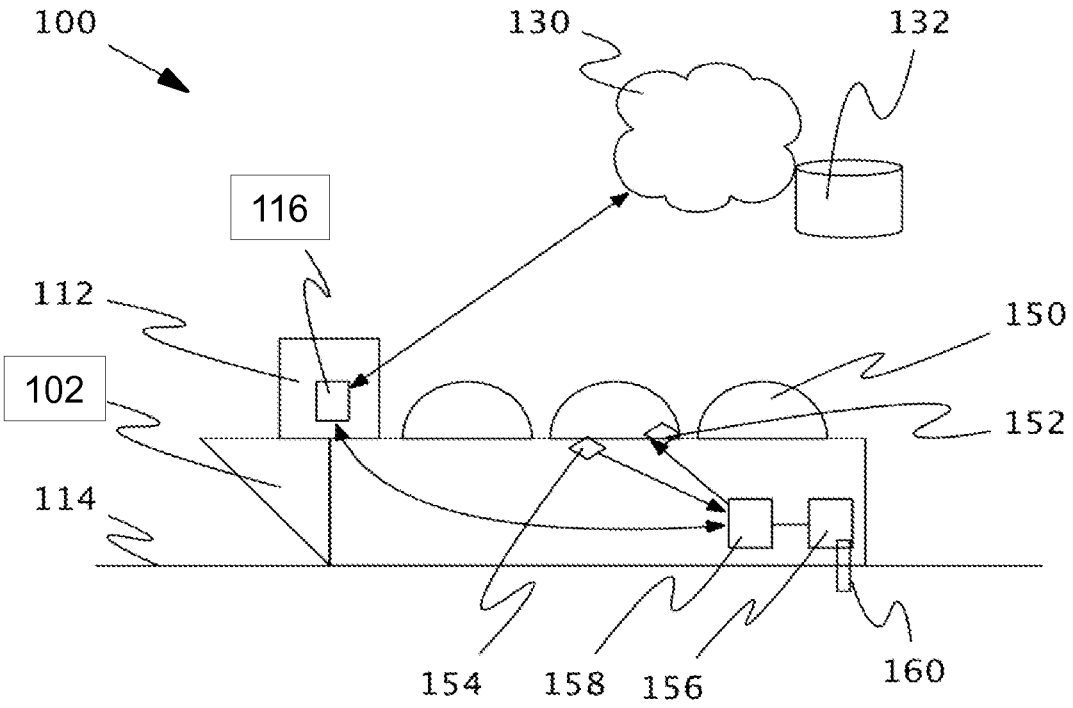
FIG. 1 is a schematic illustration of a system for controlling parameters of a storage tank disposed in a LNG carrier to manage boil-off rate, in accordance with an embodiment of the present disclosure.

In the accompanying drawings, an underlined number is employed to represent an item over which the underlined number is positioned or an item to which the underlined number is adjacent. A non-underlined number relates to an item identified by a line linking the non-underlined number to the item. When a number is non-underlined and accompanied by an associated arrow, the non-underlined number is used to identify a general item at which the arrow is pointing.

DETAILED DESCRIPTION OF EMBODIMENTS

The following detailed description illustrates embodiments of the present disclosure and ways in which they can be implemented. Although some modes of carrying out the present disclosure have been disclosed, those skilled in the art would recognize that other embodiments for carrying out or practicing the present disclosure are also possible.

The terms "connected" or "coupled" and related terms are used in an operational sense and are not necessarily limited to a direct connection or coupling. Thus, for example, two devices may be coupled directly, or via one or more intermediary media or devices. As another example, devices may be coupled in such a way that information can be passed there between, while not sharing any physical connection with one another. Based on the present disclosure provided herein, one of ordinary skill in the art will appreciate a variety of ways in which connection or coupling exists in accordance with the aforementioned definition.

The phrases "in an embodiment", "in accordance with an embodiment" and the like generally mean the particular feature, structure, or characteristic following the phrase is included in at least one embodiment of the present disclosure, and may be included in more than one embodiment of the present disclosure. Importantly, such phrases do not necessarily refer to the same embodiment.

If the specification states a component or feature "may", "can", "could", or "might" be included or have a characteristic, that particular component or feature is not required to be included or have the characteristic.

In one aspect, an embodiment of the present disclosure provides a system for controlling a vessel comprising a storage tank for a natural gas in liquid phase and gas phase, the system comprising:

- a storage tank for a natural gas in liquid phase and gas phase and comprising at least one discharge pipeline for the gas phase;
- means for determining a mass flow from gas phase of the natural gas at a discharge pipeline of the gas phase of the storage tank, means for measuring a temperature and a pressure of the gas phase of the natural gas in the storage tank;

means for determining a volume of the gas phase of the natural gas in the storage tank, a volume of the liquid phase of the natural gas in the storage tank, a density of the gas phase of the natural gas in the storage tank, a mass of the gas phase of the natural gas in the storage tank and a mass of the liquid phase of the natural gas in the storage tank;

a boil-off rate measuring unit configured to apply a dynamical model to the measured values to determine real-time boil-off rate of the natural gas in the storage tank; and a control unit configured to use the determined real-time boil-off rate in the storage tank to control at least one operation related to the vessel.

In another aspect, an embodiment of the present disclosure provides a method for determining a substantially real-time boil-off rate or a momentary boil-off rate for a storage tank for a natural gas in liquid phase and gas phase, the method comprising the steps of:

determining a mass flow from the gas phase of the natural gas at a discharge pipeline of the gas phase of the storage tank;

determining a volume of the gas phase of the natural gas and a volume of the liquid phase of the natural gas in the storage tank;

measuring a temperature and a pressure of the gas phase of the natural gas in the storage tank;

determining a density of the gas phase of the natural gas in the storage tank using a thermodynamic equation of state, the temperature in the storage tank, the pressure of the gas phase of the natural gas in the storage tank and a molar mass of the natural gas;

determining a mass of the gas phase of the natural gas in the storage tank by using the determined density of the gas phase of the natural gas and the determined volume of the gas phase of the natural gas in the storage tank;

determining a mass of the liquid phase of the natural gas in the storage tank by using a mass density of the liquid phase of the natural gas and the determined volume of the liquid phase of the natural gas, and applying a dynamical model to the measured and determined values to determine the boil-off rate in the storage tank.

The present solution thus provides a method and system for accurately determining a real-time boil-off rate for a storage tank comprising natural gas. Contrary to prior art solutions, the present solution aims at estimating the actual physical rate of evaporation of fluid in the storage tank, instead of simply approximating the boil-off rate by flow rate readings obtained from a discharge pipeline, or using an indirect boil-off indicator (e.g. the pressure in the storage tank). Furthermore, contrary to prior art solutions, the boil-off rate measurements are obtained from multiple different sources, i.e. both from the liquid phase and from the gas phase simultaneously, and a dynamical model is applied to combine the data sources to obtain an accurate real-time boil-off rate. The use of a dynamical model also diminishes the effect of noise in the measurements, thus further increasing the accuracy of the end result. This real-time boil-off rate can be used for example for controlling a vessel comprising the storage tank, as will be discussed in more detail below Another embodiment of the present disclosure provides a method for controlling a storage tank for a natural gas in liquid phase and gas phase, wherein a (real-time or momentary) boil-off rate is determined according to the present disclosure and the determined boil-off rate is used as input to a control unit controlling operation of an at least one valve or at least one compressor related to the storage tank.

According to an embodiment, the method further comprises determining a mass flow from the liquid phase of the natural gas at a discharge pipeline of the liquid phase of the storage tank. The method may also further comprise (in addition or instead of) determining a mass flow into the liquid phase of the natural gas at a loading pipeline of the liquid phase of the storage tank.

The system for managing the boil-off rate by controlling parameters is implemented in a LNG carrier configured to include one or more storage tanks. Each of the storage tanks can store the natural gas in gas phase and liquid phase. The liquid phase of the natural gas can also be referred to as a liquefied natural gas (LNG). The LNG carrier transports the natural gas to other destinations via sea route in a cryogenic liquid phase where pipes cannot be used for transportation. In an embodiment, the LNG carrier may include transfer devices for loading or unloading of LNG within the one or more storage tanks. The LNG carrier may include a processing unit configured to process LNG so as to remove impurities therein.

The storage tank may be configured to have a loading/discharge pipeline for the liquid phase of the natural gas in the storage tank and a discharge pipeline for extracting the gas from the gas phase of the natural gas in the storage tank. It is thus possible that the storage tank only has a discharge pipeline for the gas. Furthermore, it is also possible to use either one pipeline for the liquid phase, i.e. to use the same pipeline both for loading and discharge, or it is possible to use one (or more) pipelines for loading and another (or several other) pipeline for discharging the liquid phase. In the following, when the term "loading/discharge" or "loading and/or discharge" is used, both options are meant. Similarly, even when a loading/discharge pipeline of the liquid phase is mentioned, the embodiment disclosed also covers the option where only a gas phase discharge pipeline is in use or exists. In an embodiment, valves of the loading/discharge pipeline for the liquid phase or the discharge pipeline of the gas phase are controlled to control pressure within the storage tank. In an embodiment, the controlling of pressure of the storage tank includes controlling of opening and closing of at least one valve to control volumes of the liquid phase of the natural gas and the gas phase of the natural gas in the storage tank. According to an embodiment of the method for controlling the storage tank, at least one valve is selected from a group consisting of valves controlling the liquid phase discharge/loading pipeline and the gas phase discharge pipeline.

The storage tank is configured to include one or more sensors or devices for measuring values of the respective thermodynamic variables which can affect the boil-off rate of the storage tank. The storage tank includes means for determining a mass flow from the gas phase of the natural gas at the discharge pipeline of the storage tank. The means for determining a mass flow from the gas phase of the natural gas can include but not limited to a mass flow meter, a mass flow measuring sensor, one or more pressure transducers for measuring the mass flow rate, magnetic flow rate meter, a vibration type flow rate sensor, a rotating mass flow meter, doppler based flow meter, differential pressure based flow meters such as orifice plates, flow nozzles, venture tubes, or rotameters, velocity flow meters, pitot tubes, calorimeter flow-meter, vortex flow meter, electromagnetic flow meter, ultrasonic doppler flow meter, positive displacement flow meter, thermal flow meter and the like.

The storage tank includes means for determining a mass flow into the liquid phase of the natural gas at the discharge/loading pipeline of the storage tank. The means for determining the mass flow into the liquid phase of the natural gas can include but not limited to a mass flow meter, a mass flow measuring sensor, one or more pressure transducers for measuring the mass flow rate, magnetic flow rate meter, a vibration type flow rate sensor, a rotating mass flow meter, doppler based flow meter, differential pressure based flow meters such as orifice plates, flow nozzles, venture tubes, or rotameters, velocity flow meters, pitot tubes, calorimeter flow-meter, vortex flow meter, electromagnetic flow meter, ultrasonic doppler flow meter, positive displacement flow meter, thermal flow meter and the like.

The storage tank includes means for measuring a volume of the gas phase of the natural gas. The means for measuring the volume of the gas phase of the natural gas may include pressure sensors based gas flow meters, velocity type gas meters, head type gas meters, acoustic gas meters, racer type gas meters, pressure transducers and other gas volume measurement devices. In an embodiment, the storage tank includes a liquid level sensor disposed on top of the storage tank so as to measure the distance of the surface level of LNG from the top of the storage tank. Since the geometry of the storage tank is known, the measured distance can be used to calculate volume (Vl) of the liquid phase of the natural gas.

The storage tank includes means for measuring a temperature of the natural gas. The means for measuring the temperature of the gas phase of the natural gas includes temperature sensors, resistant temperature devices, thermocouple devices, integrated circuit based sensors, mechatronic temperature devices, and other temperature measuring devices. In an embodiment, the storage tank can include one or more temperature sensors for measuring the temperature at different regions of the storage tank. In an embodiment, one or more temperature sensors measure the temperature of the gas phase of the natural gas and one or more sensors measure the temperature of the liquid phase of the natural gas within the storage tank. According to an embodiment, the temperature of the gas phase of the natural gas is measured using at least one temperature sensor disposed above the surface of the liquid phase of the natural gas.

The storage tank includes means for measuring a pressure of the gas phase of the natural gas. The means for measuring the pressure of the gas phase of the natural gas includes pressure sensors, pressure gauges, diaphragm seals, Bourdon gauges, piston gauges, compression gauge, U-tube gauge, piezo-resistive diaphragm gauge, pressure transmitters, and other pressure measuring devices. In another example, the storage tank may include one or more pressure sensors to determine the pressure being generated by the gas phase of the natural gas within the tank.

The system includes a boil-off rate measuring unit to determine a substantially momentary boil-off rate for the storage tank. In an embodiment, the boil-off rate measuring unit includes an input element, a processor, and a memory to determine the momentary boil-off rate for the storage tank. The input element is configured to receive input from one or more analogue or digital devices. In an embodiment, the input element can include an analogue to digital converter so as to directly receive signal from analogue devices such as sensors and convert these signals into digital signal for further processing. In addition, the input element can be configured to receive digital information directly from one or more of the sensors. The digital information can be for example temperature information sent to the apparatus using standardized or proprietary format.

In an embodiment, the processor may comprise one or more commercially available microprocessors or microcontrollers that facilitate data processing and storage using various support circuits including one or more clock circuits, power supplies, cache, input/output circuits, and the like. In an embodiment, the memory may comprise at least one of Read Only Memory (ROM), Random Access Memory (RAM), disk drive storage, optical storage, removable storage and/or the like.

The boil-off rate measuring unit is configured to directly receive values of the thermodynamic variables such as measured or determined mass flow (fg) from the gas phase of the natural gas at a discharge pipeline of the storage tank, mass flow (fl) into the liquid phase of the natural gas at an loading/discharge pipeline of the storage tank, measured volume (Vg) of the gas phase of the natural gas, measured temperature (Tg) and pressure (Pg) of the gas phase of the natural gas as an input values. In an example, the temperature (Tg) can be an average temperature measured using outputs of one or more temperature sensors disposed above the liquid surface level of the liquid phase of the natural gas. In another example, the volume (Vg) of the gas phase of the natural gas and the volume (Vl) of the liquid phase of the natural gas is measured using the output of the liquid level sensor. Alternatively, the boil-off rate measuring unit is configured to receive values of the thermodynamic variables from an on-vessel computing device. The measured values are first transmitted to the on-vessel computing device which may process these values and subsequently, transmit these values to the input element of the boil-off rate measuring unit. Further, the processor of the boil-off rate measuring unit is configured to process the input information received at the boil-off rate measuring unit with respect to time (t) in accordance with the instructions stored in the memory.

The boil-off rate measuring unit is configured to apply a dynamical model to the measured values to determine the real-time boil-off rate. In an embodiment, the boil-off rate measuring unit is configured to include an output element such that the processor transmits the determined real-time boil-off rate to the output element. The real-time boil-off rate can be used for example as an input to a control unit controlling at least one operation relating to controlling the pressure of the storage tank, modifying a course of a vessel carrying the storage tank and activating sprayer to reduce the temperature of the storage tank. Controlling the pressure may include controlling of opening and closing of at least one of valve related to the liquid phase discharge/loading pipeline or gas phase discharge pipeline. According to yet another embodiment, the gas phase of the natural gas obtained from the gas phase discharge pipeline is further processed and re-liquefied so as to be stored again within the storage tank.

According to an embodiment, the system according to the present description further comprises at least one discharge pipeline for the liquid phase, and means for determining a mass flow into liquid phase of the natural gas at at least one of the discharge pipelines of the liquid phase of the storage tank. According to another embodiment, the system further comprises at least one loading pipeline for the liquid phase and means for determining a mass flow into liquid phase of the natural gas at at least one of the loading pipelines of the liquid phase of the storage tank.

In an embodiment, the dynamical model is selected from a group of statistical state-space models. Further, the unknown parameters of the dynamical model can be estimated with the Kalman filter or Kalman smoother method. For illustration purposes only, there will now be considered an exemplary dynamic model for determining a substantially momentary boil-off rate for the storage tank pursuant to embodiments of the present disclosure.

The table 1 lists out the variables based on which the boil-off rate measuring unit is configured to determine momentary boil-off rate for the storage tank.

TABLE 1

| Variable | Unit | Description | Source |
|---|---|---|---|
| $f_b$ | kg/s | Mass flow from the liquid phase to the gas phase | Estimated |
| $f_g$ | kg/s | Mass flow (fg) from the gas phase of the natural gas at an discharge pipeline of the storage tank | Measured |
| $f_l$ | kg/s | Mass flow (fl) into the liquid phase of the natural gas at an loading/discharge pipeline of the storage tank | Measured |
| $m_g$ | kg | Total mass of the gas phase | Calculated |
| $m_l$ | kg | Total mass of the liquid phase | Calculated |
| $T_g$ | K | Average temperature of the gas phase | Calculated/ Measured |
| $p_g$ | Pa | Pressure in the gas phase | Measured |
| $\rho_g$ | kg/m$^3$ | Average mass density of the gas phase | Calculated |
| $\rho_l$ | kg/m$^3$ | Mass density of the liquid phase | Measured/ Assumed |
| $V_g$ | m$^3$ | Volume of the gas phase | Measured |
| $V_l$ | m$^3$ | Volume of the liquid phase | Measured |
| M | g/mol | Molar mass in the gas phase | Measured/ Assumed |
| t | s | Time | Measured |

The output of the sensors can assist in measurement of those variables which are indicated as measured variables in the table 1, whereas the on-vessel computing device provides the remaining variables to the boil-off rate measuring unit. Further, the mass density of the liquid phase of the natural gas varies due to different compositions of the natural gas. Therefore, the on-vessel computing device is configured to determine the mass density of the liquid phase and provide the same to the boil-off rate measuring unit, alternatively a default value for the mass density of liquid phase can be used.

The mass of the liquid phase, ml can be calculated from the density of the liquid phase (assumed known), and its volume (volume is measured for example with a level sensor) by the following equation:

$$m_l = V_l \rho_l.$$

Given a suitable expression for the molar volume in the gas phase, v, which is calculated from a chosen equation of state and depends on the local temperature and pressure, the mass of the gas phase can be written as an integral over the volume of the gas:

$$m_g = \int_{V_g} \frac{M}{v(T(x),\ p_g)} d^3x.$$

As an example, in the ideal gas approximation, $$v(T,\ p) = \frac{RT}{p},$$

-continued and hence $$m_g = \frac{Mp_g V_g}{RT_g},$$

where $$T_g = \left(\frac{1}{V_g}\int \frac{dx^3}{T(x)}\right)^{-1}.$$

Conservation of mass dictates that between two measurements, labeled by indices i+1 and i and occurring at times ti+1 and ti, the masses should evolve as:

$$m_{l,i+1} = m_{l,i} + (f_{l,i} - f_{b,i})(t_{i+1} - t_i)$$

$$m_{g,i+1} = m_{g,i} + (f_{b,i} - f_{g,i})(t_{i+1} - t_i)$$

Hence we have two separate noisy measurements of the boil-off rate (fb), later referred to as the naïve boil-off estimates:

$$f_{b,i} = -\frac{m_{l,i+1} - m_{l,i}}{t_{i+1} - t_i} + f_{l,i}$$

$$f_{b,i} = \frac{m_{g,i+1} - m_{g,i}}{t_{i+1} - t_i} + f_{g,i}$$

The boil-off rate measuring unit is configured to apply a statistical dynamic model or a state based dynamical model on the measured values. For example, the boil-off rate measuring unit can estimate the true values of fb, mg, and ml at each time. Let us denote the best guess values are with a hat. The state evolves in time as follows:

$$\hat{f}_{b,i+1} = \hat{f}_{b,i} + \epsilon 1,i$$

$$\hat{m}_{l,i+1} = \hat{m}_{l,i} + (\hat{f}_{l,i} - \hat{f}_{b,i})(t_{i+1} - t_i) + \epsilon_{2,i}$$

$$\hat{m}_{g,i+1} = \hat{m}_{g,i} + (\hat{f}_{b,i} - \hat{f}_{g,i})(t_{i+1} - t_i) + \epsilon_{3,i}$$

and the measurement equations are:

$$m_{g,i+1} = \hat{m}_{g,i+1} + \delta_{1,i+1}$$

$$m_{l,i+1} = \hat{m}_{l,i+1} + \delta_{2,i+1}.$$

The random variables are distributed as:

$$(\epsilon_{1,i}, \epsilon_{2,i}, \epsilon_{3,i}) \sim \mathcal{N}(0, Q_i)$$

$$(\delta_{1,i}, \delta_{2,i}) \sim \mathcal{N}(0, R_i)$$

In the simplest case, Qi and Ri can be assumed diagonal and constant. The statistical model combines the measurements of the gas and liquid mass to give a more accurate measurement of the boil-off rate. Tuning the parameters Q and R allows one to control the influence of the liquid and vapour measurements on the boil-off rate, and also to control how quickly the boil-off rate can vary in time.

The described statistical model facilitates the determination of the real-time boil-off rate (fb) value. If the history of the variable mg at time ti is denoted mg,0:i, the real-time boil-off estimate is the expectation value of fb given measurements up to that time:

$$E[\hat{f}_{b,i} | m_{l,0:i}, m_{g,0:i}].$$

In an embodiment, this estimation task is done with the linear Kalman filter method.

It is also possible to estimate the momentary boil-off rate after the voyage, to gain a more robust measurement of the boil-off rate. The momentary, but not real-time, boil-off estimate is the expectation value of fb given all measurements during the voyage:

$$E[\hat{f}_{b,i}|m_{l,0:k},m_{g,0:k}]\forall i,$$

where tk is the time at which the voyage ended. For this estimation task the Kalman smoother method can be applied.

The boil-off rate measuring unit which determines the real-time boil-off rate for the storage tank is configured to provide this information to the control unit. The control unit may receive or identify desired values corresponding to the boil-off rate and the thermodynamic variables. The control unit is configured to compare determined real-time boil-off rate with a desired boil-off rate value so as to control at least one operation relating to the storage tank.

According to one or more embodiments, the on-vessel computing device identifies the desired boil-off rate corresponding to the storage tank and provides the desired boil-off rate and other values of the thermodynamic variables to the control unit. Subsequently, the control unit monitors the boil-off rate obtained from the boil-off rate measuring unit and the sensors output on a real-time basis; and controls the operation of the valves controlling the liquid phase loading/discharge pipeline and gas phase discharge pipeline so as to maintain the desired conditions in the storage tank. The control unit can be used to influence the volumes of the gas phase and the liquid phase of the natural gas within the storage tank by controlling the valves controlling the gas phase discharge pipeline and the valves related to the liquid phase discharge/loading pipeline respectively. The change in the volumes of the gas and liquid phases of the natural gas can affect the boil-off rate of the storage tank which can be under the control of the control unit.

In an embodiment, the on-vessel computing device is configured to communicatively couple to a server via a communication network so as to obtain information which can be used for controlling vessel operations using the measured boil-off rate. In an example, the communication network may be a collection of individual networks, interconnected with each other and functioning as a single large network. Such individual networks may be wired, wireless, or a combination thereof. Examples of such individual networks include, but are not limited to, Local Area Networks (LANs), Wide Area Networks (WANs), Metropolitan Area Networks (MANs), Wireless LANs (WLANs), Wireless WANs (WWANs), Wireless MANs (WMANs), the Internet, second generation (2G) telecommunication networks, third generation (3G) telecommunication networks, fourth generation (4G) telecommunication networks (and other cellular communication), satellite communication networks, Worldwide Interoperability for Microwave Access (WiMAX) networks, and short-range wireless communications network, such as a "Bluetooth" network ("Bluetooth" is a registered trademark).

In an example, the on-vessel computing device transmits the historical data of the boil-off rate and other thermodynamic variables to the server. The server may process the historical data to determine a desired boil-off rate so as to minimize loss of the natural gas as boil-off gas or to make informed decisions about vessel operations. The server may also determine the desired thermodynamic values for the storage tank under different environmental conditions. Accordingly, the on-vessel computing device receives the desired values from the server and forwards the same to the control unit so that the control unit manages the operation of the LNG carrier.

The movement of the LNG carrier generates waves within the liquid phase of the natural gas stored within the storage tank. The motions of the LNG carrier in a rough sea can substantially increases the boil-off rate. Therefore, the control unit may change an existing route of the LNG carrier to a different route in order to decrease boil-off caused by rough weather. In addition, the control unit may change one or more operations such as speed or encounter angle on the sea waves for the LNG carrier so as to decrease the boil-off rate.

In another example, the control unit may activate spraying with a spraying unit so as to cool down the tank in order for example to gain a lower long-term boil-off rate for the storage tank. For example, the control unit may determine an extent of cooling required to be delivered to the storage tank so as to maintain the boil-off rate within the desired values. The control unit may also determine the extent of cooling required. In another example, the boil-off rate measurement using the boil-off rate measuring unit enables the on-vessel computing device and the control unit to detect leakage within the storage tank or other elements of the LNG carrier.

Further, the on-vessel computing device controls the use of the boil-off gas released from the storage tank. In an embodiment, the boil-off gas obtained from the storage tanks is re-liquefied using a re-liquefy unit and send back to the storage tank. For example, the LNG carrier includes a compressor which compresses the boil-off gas released from the storage tank and directs the compressed gas to the re-liquefaction plant. Subsequently, the re-liquefaction plant processes the released boil-off gas to a desired composition and re-liquefies the boil-off gas. The on-vessel computing device controls an opening of the valve of the storage tank liquid phase loading pipeline and re-inserts the liquefied boil-off gas within the storage tank. In another embodiment, the on-vessel computing device may direct the boil-off gas to a LNG carrier engine where it can be used as a carrier fuel. As a result, the LNG carrier becomes an economical and energy efficient transportation carrier for LNG.

DETAILED DESCRIPTION OF THE DRAWINGS

Referring to FIG. 1, illustrated is an example illustration of a system 100 for controlling parameters of one or more of the storage tanks 150 to manage boil-off rate for a LNG carrier 102. The LNG carrier 102 includes a bridge 112 for manoeuvring the LNG carrier 102 which is floating on sea 114. An on-vessel computing device 116 is disposed within the bridge 112. The on-vessel computing device 116 is connected via communication network 130 to a server 132. The server 132 can be used to perform some or all of the calculations related to controlling parameters of one or more of the storage tanks 150 or the carrier 102 to manage of the boil-off rate or can be used to provide parameters related to the boil-off rate management to the on-vessel computing device 116. The LNG carrier 102 has one or more cryogenic storage tanks 150 configured to store liquid phase of the natural gas (i.e., LNG). The storage tank 150 has a discharge valve 154 for releasing out the gas phase of the natural gas from the storage tank 150. The storage tank 150 has a loading/discharge valve 152 for adding the liquid phase of the natural gas to the storage tank 150 or removing the liquid phase of the natural gas from the storage tank 150. The valves 154 and 152 can be controlled for example via a control unit. Further, the LNG carrier 102 includes a compressor unit 158 configured to re-liquefy boil-off gas received via the output valve 154 and to feed it back to the storage tank 150 via the loading pipeline valve 152. Depending on the configuration, a part or all of the boil-off gas received via the gas phase discharge valve 154 can be fed to an engine 156 of the LNG carrier 102 to operate a propulsion system 160.

Figure 2:
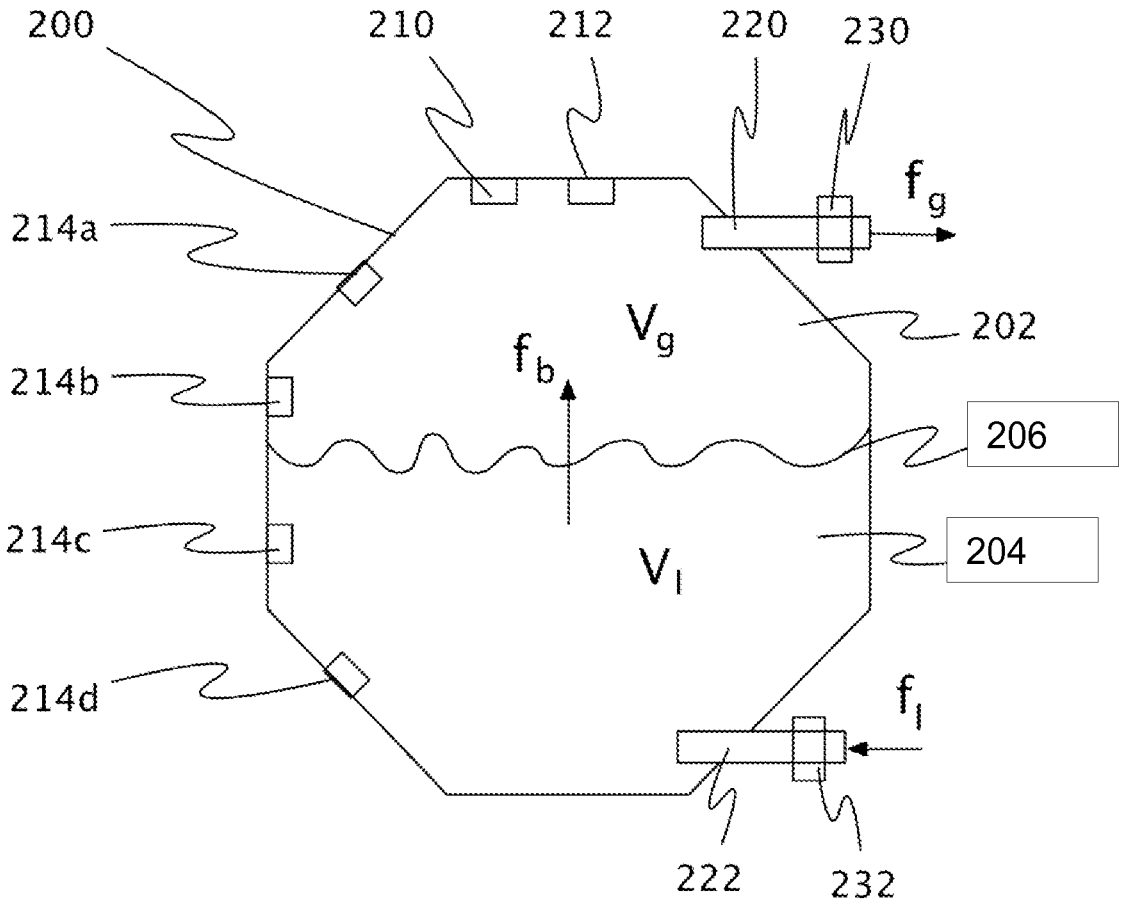
FIG. 2 is an example illustration of placement of sensors within the storage tank of the LNG carrier, in accordance with an embodiment of the present disclosure.

Referring to FIG. 2, illustrated is an example illustration of placement of sensors within a storage tank 200 of the LNG carrier. The storage tank 200 stores the natural gas as the gas phase 202 and the liquid phase 204. A surface level of the liquid phase 204 is indicated as a level 206. Thus, a total volume (V) of the storage tank 200 can be considered as a sum of volume (Vg) of the gas phase 202 and volume (Vl) of the liquid phase 204.

The storage tank 200 is configured to include a plurality of sensors such as a liquid level sensor 210, a pressure sensor 212 and temperature sensors (e.g., 214*a*, 214*b*, 214*c* and 214*d*). The liquid level sensor 210 is used to determine distance of the surface level 206 from a top of the storage tank 200 so as to calculate the volume (Vl) of the liquid phase 204. The pressure sensor 212 is used to monitor pressure (p) of the volume (Vg) of the gas phase 202.

The temperature sensors 214*a*, 214*b*, 214*c* and 214*d* can be used to measure temperature (T) at different levels of the storage tank 200. For example, the temperature sensors 214*a* and 214*b* are used to measure the temperature of a region occupying the gas phase 202 and the temperature sensors 214*c* and 214*d* are used to measure the temperature of a region occupying the liquid phase 204. An output pipe 220 is used to lead the gas phase 202 of the natural gas out of the storage tank 200 via a valve 230. A mass flow from the gas phase 202 is designated with fg.

An input pipe 222 is used to lead the liquid phase 204 of the natural gas in to the storage tank 200 via a valve 232. A mass flow into the liquid phase 204 is designated with fl. The valves 230 and 232 can be controlled by a control unit corresponding to the on-vessel computing device 116 so as to control the boil-off rate of the storage tank 200. As shown, the boil-off rate i.e. mass flow from the liquid phase 204 to the gas phase 202 during a time t is designated with fb. The values of these thermodynamic variables will be used as an input to determine real-time boil-off rate of the storage tank 200.

Figure 3:
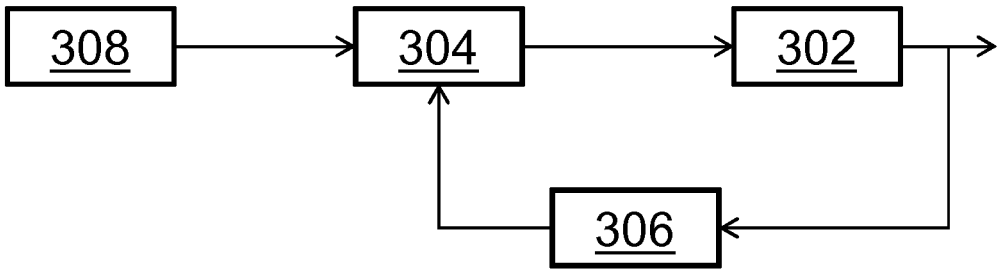
FIG. 3 is an example illustration of a control system for controlling parameters of a storage tank disposed in a LNG carrier or to manage parameters related to vessel operations to manage boil-off rate, in accordance with an embodiment of the present disclosure.

Referring to FIG. 3, illustrated is an example illustration of a control system for controlling the boil-off rate of the storage tank as a process 302. The process 302 includes at least controlling opening and closing of the gas phase discharge valve 230 and/or opening and closing of liquid phase discharge/loading valve 232. These valves can be used to control volumes of the liquid phase and the gas phase in the storage tank 200. An opening/closing of the valve 230 has an impact on pressure (p) of the gas phase of the natural gas.

As shown, the process 302 is controlled using a controller 304 which facilitates a control loop feedback mechanism used in industrial control systems. The controller 304 receives process state related input from a boil-off rate measuring unit 306 and desired values for the process 302 from an on-vessel computing device 308. The values can be set by person or can be derived from database or be calculated. In addition, a user may provide input for the process 302 using a display unit showing current boil-off rate to the user. The controller 304 can control the one or more operations of the storage tank 200 or the LNG carrier based on the input received from the on-vessel computing device 308 and the boil-off rate measuring unit 306.

Figure 4:
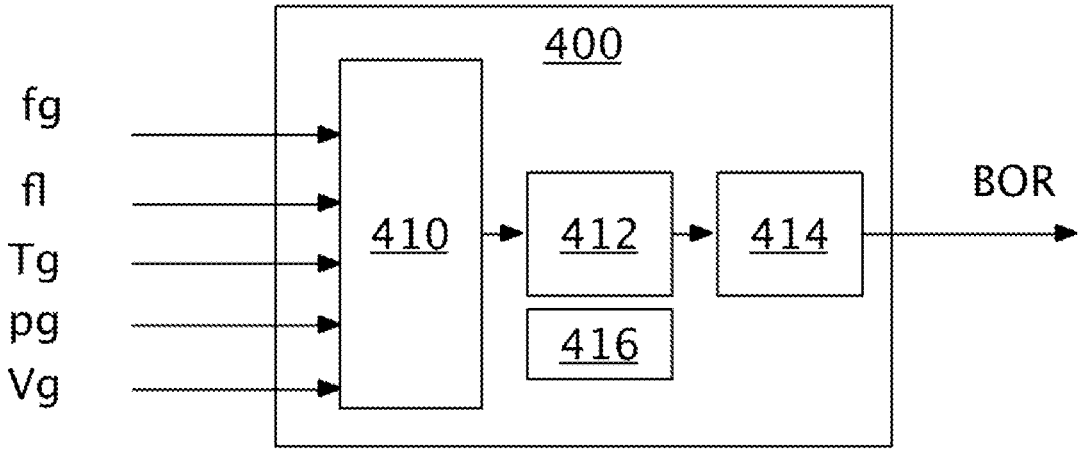
FIG. 4 is an example illustration of a boil-off rate measuring unit, in accordance with an embodiment of the present disclosure.

Referring to FIG. 4, illustrated is an example illustration of a boil-off rate measuring unit 400 configured to determine the momentary boil-off rate using one or more thermodynamic variables. The boil-off rate measuring unit 400 is configured to receive at least measured mass flow (fg) from the gas phase of the natural gas at an discharge pipeline of the storage tank, the mass flow (fl) into the liquid phase of the natural gas at an discharge/loading pipeline of the storage tank, volume (Vg), temperature (Tg) and pressure (Pg) of the gas phase of the natural gas as an input for an input element 410. The input element 410 can contain analogue to digital (A/D) converters to convert possible analogue signals from one or more of the sensors to digital signal respectively. The digital information from the input element 410 is forwarded to a processor 412 which processes the information in accordance with the instructions stored in its associated memory 416. The instructions comprises steps of receiving measured values, applying dynamic model (such as dynamic statistical model or dynamic state-space model) to determine the momentary boil-off rate values using the measured values and the model. The derived boil-off rate is provided to an output element 414 through which the derived boil-off rate is provided as an input to the for example, a controller 304 or to other systems.

Figure 5:
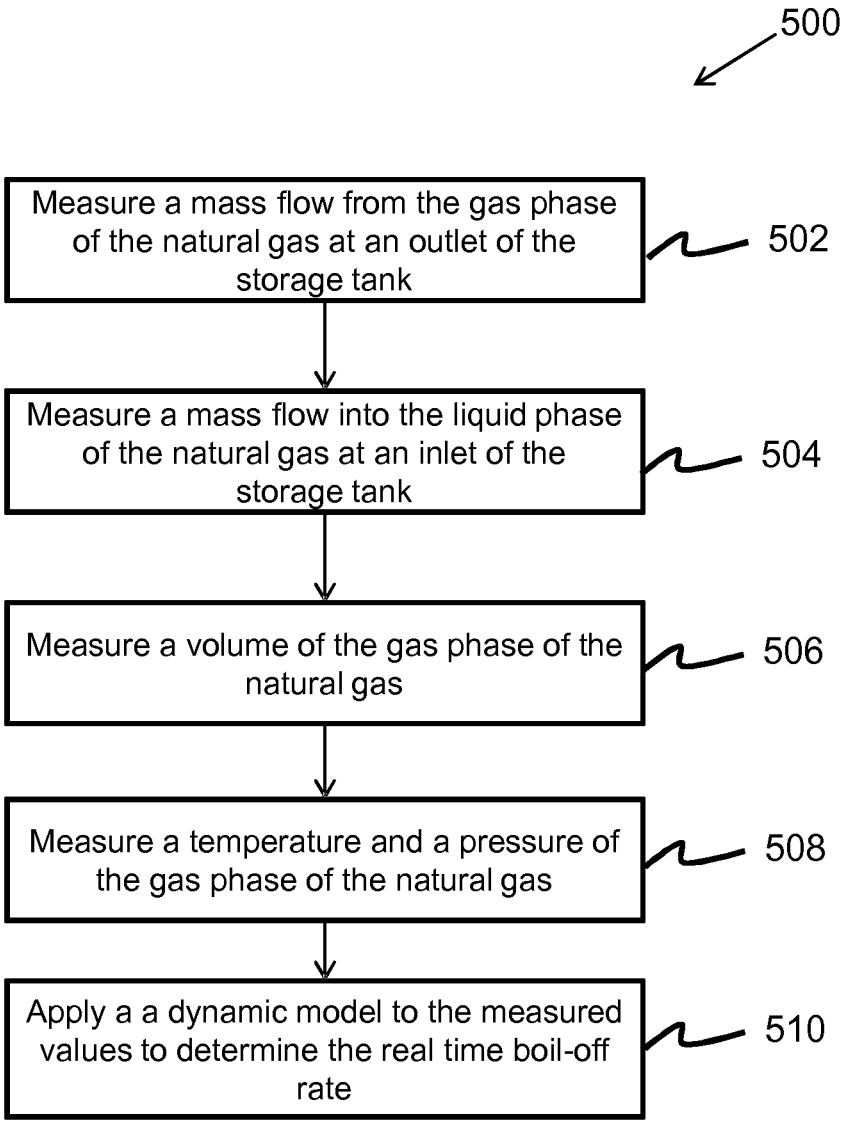
FIG. 5 is an illustration of steps of a method for determining a substantial real-time boil-off rate for the storage tank, in accordance with an embodiment of the present disclosure.

FIG. 5 is an illustration of steps of a method 500 for determining a substantially real-time boil-off rate for a storage tank for a natural gas in liquid phase and gas phase via a boil-off rate measuring unit, in accordance with an embodiment of the present disclosure. Specifically, the method 500 is associated with the boil-off rate measuring unit 400 (explained in conjunction with FIG. 4) for determining the boil-off rate.

At step 502, a mass flow from the gas phase of the natural gas at an discharge pipeline of the storage tank is measured and at step 504, a mass flow into the liquid phase of the natural gas at a discharge/loading pipeline of the storage tank is measured.

At step 506, a volume of the gas phase of the natural gas is measured and at step 508, a temperature and a pressure of the gas phase of the natural gas is measured.

At step 510, a dynamic model to the measured values is applied to determine the real-time boil-off rate.

Further, the steps 502, 504, 506, 508 and 510 are only illustrative and other alternatives can also be provided where one or more steps are added, one or more steps are removed, or one or more steps are provided in a different sequence without departing from the scope of the claims herein. For example, in the method 500, the dynamic model is selected from the dynamical model is selected from a group of statistical state-space models. Further, the measurement of the volume of the gas phase is performed using a liquid level sensor.

Figure 6:
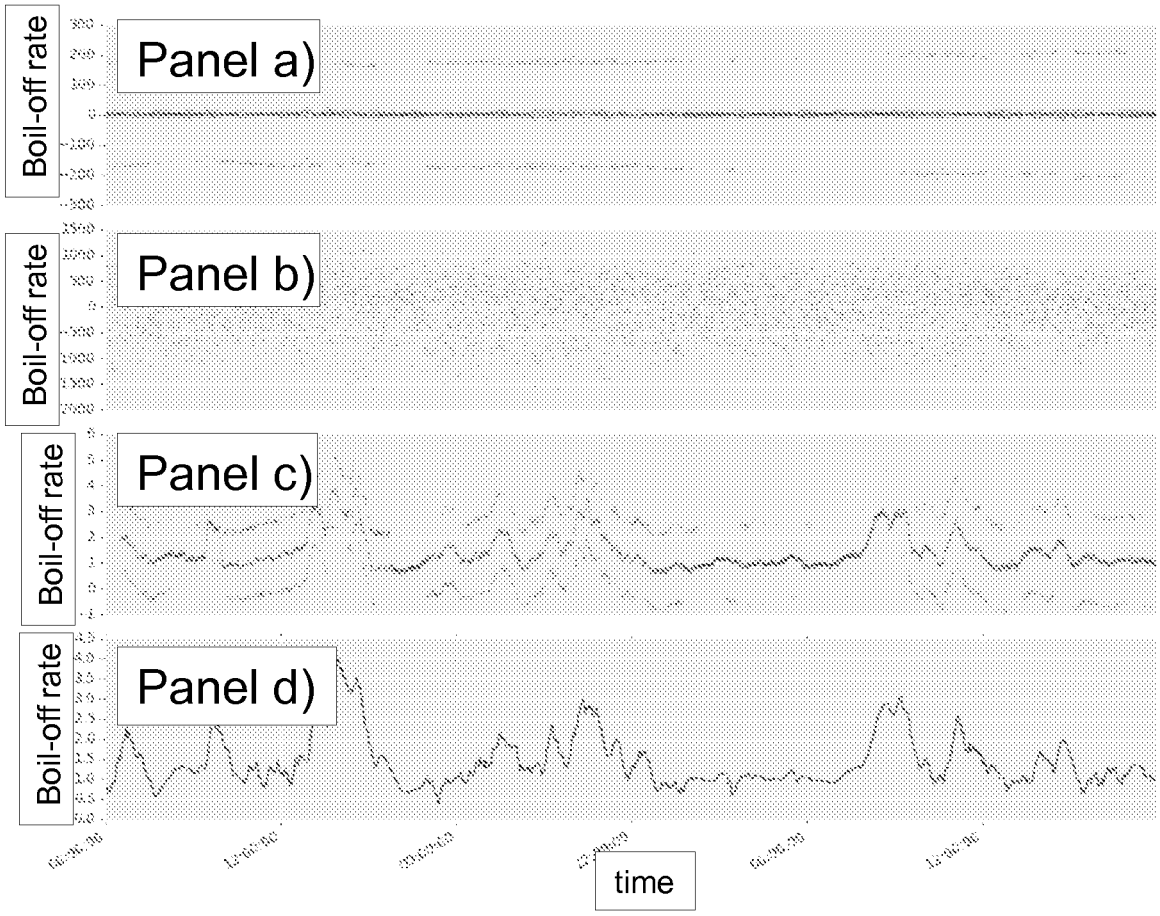
FIG. 6 is an illustration of determining real-time boil-off rate for a laden voyage in accordance with an embodiment of the present disclosure.

Referring to FIG. 6, illustrated is an example of calculated boil-off rate with the naive methods as explained above compared to the dynamical boil-off rate model described above. The data is taken from a 72-hour period on a laden voyage. Panel a) shows the boil-off rate calculated from the naive boil-off rate measurement based on gas 30-seconds sampled data. Panel b) shows the boil-off rate calculated from the naive boil-off rate measurement based on the liquid phase 30-seconds sampled data. Panel c) shows the same data as Panel b), but smoothed by taking a moving window average of the data over a 6-hour period. Panel d) shows the boil-off estimate with the statistical model described above. The noisy nature of the data in Panels a) and b) make the corresponding methods unusable for a real-time boil-off estimate. The method corresponding to Panel c) shows how boil-off varies accurately, but since it is based on a 6-hour lagged measurement, it is not a momentary estimate. Finally, the method corresponding to Panel d) is much less noisy and quicker to react to changes in the real boil-off rate than the other methods.

Figure 7:
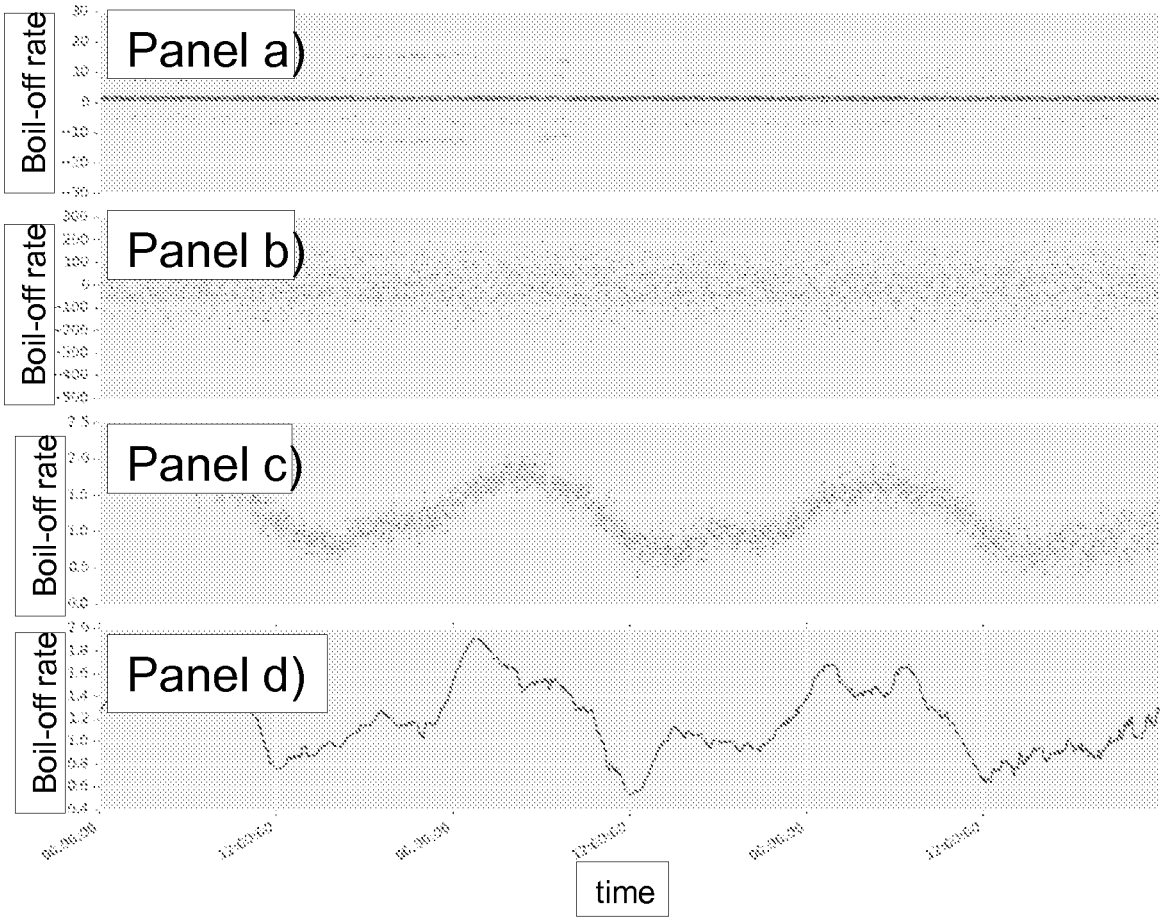
FIG. 7 is an illustration of determining real-time boil-off rate for a ballast voyage in accordance with an embodiment of the present disclosure.

Referring to FIG. 7. illustrated is an example of calculated boil-off rate with the naive methods as explained above, compared to the dynamical boil-off rate model described above. The data is taken from a 72-hour period on a ballast voyage. Panel a) shows the boil-off rate calculated from the naive boil-off rate measurement based on gas phase based on 30-seconds sampled data. Panel b) shows the boil-off rate calculated from the naive boil-off rate measurement based on the liquid phase 30-seconds sampled data. Panel c) shows the same data as Panel a), but smoothed by taking a moving window average of the data over a 1-hour period. Panel d) shows the boil-off estimate with the statistical model described above. The noisy nature of the data in Panels a) and b) make the corresponding methods unusable for a real-time boil-off estimate. The method corresponding to Panel c) shows how boil-off varies, but the signal is still noisy. Finally, the method corresponding to Panel d) is much less noisy and quicker to react to changes in the real boil-off rate than the other methods.

Modifications to embodiments of the present disclosure described in the foregoing are possible without departing from the scope of the present disclosure as defined by the accompanying claims. Expressions such as "including", "comprising", "incorporating", "have", "is" used to describe and claim the present disclosure are intended to be construed in a non-exclusive manner, namely allowing for items, components or elements not explicitly described also to be present. Reference to the singular is also to be construed to relate to the plural.

The invention claimed is:

1. A method for determining a momentary boil-off rate for a storage tank for a natural gas in liquid phase and gas phase, the method comprising:

measuring a mass flow from the gas phase of the natural gas at a discharge pipeline of the gas phase of the storage tank;

determining a volume of the gas phase of the natural gas and a volume of the liquid phase of the natural gas in the storage tank;

measuring a temperature and a pressure of the gas phase of the natural gas in the storage tank;

determining a density of the gas phase of the natural gas in the storage tank using a thermodynamic equation of state, the temperature in the storage tank, the pressure of the gas phase of the natural gas in the storage tank and a molar mass of the natural gas;

determining a mass of the gas phase of the natural gas in the storage tank by using the determined density of the gas phase of the natural gas and the determined volume of the gas phase of the natural gas;

determining a mass of the liquid phase of the natural gas in the storage tank by using a mass density of the liquid phase of the natural gas and the determined volume of the liquid phase of the natural gas and applying a dynamical model to the measured and determined values to determine the momentary boil-off rate in the storage tank.

2. A method according to claim 1, further comprising determining a mass flow from the liquid phase of the natural gas at a discharge pipeline of the liquid phase of the storage tank.

3. A method according to claim 1, further comprising determining a mass flow into the liquid phase of the natural gas at a loading pipeline of the liquid phase of the storage tank.

4. A method according to claim 1, wherein the determining of the volume of the gas phase of the natural gas and the volume of the liquid phase of the natural gas in the storage tank is performed using a liquid level sensor.

5. A method according to claim 1, wherein the temperature of the gas phase of the natural gas in the storage tank is measured using at least one temperature sensor disposed above the surface of the liquid phase of the natural gas.

6. A method according to claim 1, wherein the dynamical model is selected from a group of statistical state-space models.

7. A method according to claim 1, wherein the boil-off rate is determined in real-time.

8. A method for controlling a storage tank for a natural gas in liquid phase and gas phase, wherein a real-time boil-off rate is determined according to claim 7 and the determined boil-off rate is used as input to a control unit controlling operation of an at least one valve or at least one compressor related to the storage tank.

9. A method according to claim 8, wherein at least one valve is selected from a group consisting of valves controlling the discharge pipeline of the gas phase, the loading pipeline of the liquid phase and the discharge pipeline of the liquid phase of the storage tank.

10. A method according to claim 8, wherein the determined boil-off rate is used as input to a control unit controlling at least one operation relating to controlling the pressure of the storage tank, modifying a course of a vessel carrying the storage tank and activating a sprayer to reduce the temperature of the storage tank.

11. A method according to claim 10, wherein controlling the pressure of the storage tank includes controlling of opening and closing of at least one valve selected from a group consisting of valves controlling the discharge pipeline of the gas phase, the loading pipeline of the liquid phase and the discharge pipeline of the liquid phase of the storage tank.

12. A method according to claim 10, wherein the gas phase of the natural gas obtained from the discharge pipeline of the gas phase is further processed and re-liquefied so as to be stored again within the storage tank.

13. A system for controlling a vessel comprising a storage tank for a natural gas in liquid phase and gas phase, the system comprising:

a storage tank for a natural gas in liquid phase and gas phase and comprising at least one discharge pipeline for the gas phase;

means for measuring a mass flow from gas phase of the natural gas at a discharge pipeline of the gas phase of the storage tank, means for measuring a temperature and a pressure of the gas phase of the natural gas in the storage tank;

means for determining a volume of the gas phase of the natural gas in the storage tank, a volume of the liquid phase of the natural gas in the storage tank, a density of the gas phase of the natural gas in the storage tank, a mass of the gas phase of the natural gas in the storage tank and a mass of the liquid phase of the natural gas in the storage tank;

a boil-off rate measuring unit configured to apply a dynamical model to the measured values to determine real-time boil-off rate in the storage tank; and a control unit configured to use the determined real-time boil-off rate in the storage tank to control at least one operation related to the vessel.

14. A system according to claim 13, further comprising at least one discharge pipeline for the liquid phase and means for determining a mass flow into liquid phase of the natural gas at at least one of the discharge pipelines of the liquid phase of the storage tank.

15. A system according to claim 13, further comprising at least one loading pipeline for the liquid phase and means for determining a mass flow into liquid phase of the natural gas at at least one of the loading pipelines of the liquid phase of the storage tank.

* * * * *